US005226276A

United States Patent [19]

Cahill

[11] Patent Number: 5,226,276

[45] Date of Patent: Jul. 13, 1993

[54] FREE STANDING WALL CONSTRUCTION, A METHOD OF CONSTRUCTING SAME, AND A PRECAST ELONGATED CONSTRUCTION MEMBER

[76] Inventor: William R. Cahill, 726 Prospect Hill Dr., Martinsville, Va. 24112

[21] Appl. No.: 773,524

[22] Filed: Oct. 9, 1991

[51] Int. Cl.[5] ..... E04C 1/10; E04C 1/30; E04G 21/22

[52] U.S. Cl. ..... 52/595; 52/744

[58] Field of Search ..... 52/589, 593, 595, 437–442, 52/405, 406, 124.2, 133, 744

[56] References Cited

U.S. PATENT DOCUMENTS

| | | | |
|---|---|---|---|
| 764,459 | 7/1904 | Hackman | 52/595 |
| 918,393 | 4/1909 | Tarr | 52/133 |
| 1,884,319 | 10/1932 | Smith | 52/405 |
| 2,021,341 | 11/1935 | Ward | 52/595 |
| 2,199,112 | 4/1940 | O'Leary | 52/405 |
| 2,887,869 | 5/1959 | Mckay | 52/438 |
| 3,189,950 | 6/1965 | Johnson | 52/286 |
| 3,342,033 | 9/1967 | Crouch et al. | 52/744 |
| 3,371,459 | 3/1968 | Thomas et al. | 52/744 |
| 3,422,588 | 1/1969 | Stewart, Jr. | 52/595 |
| 3,435,567 | 4/1969 | Tyson | 52/125.4 |
| 3,600,864 | 8/1971 | Godley | 52/314 |
| 3,908,324 | 9/1975 | Stout | 52/405 |
| 4,016,693 | 4/1977 | Warren | 52/404 |
| 4,126,977 | 11/1978 | Chisum | 52/233 |
| 4,219,978 | 9/1980 | Brown | 52/286 |

FOREIGN PATENT DOCUMENTS

| | | | |
|---|---|---|---|
| 147005 | 9/1950 | Australia | 52/438 |

*Primary Examiner*—James L. Ridgill, Jr.
*Attorney, Agent, or Firm*—Charlie T. Moon

[57] ABSTRACT

An improved load bearing elongated precast construction member is used for erecting a free standing load bearing wall including a plurality of the construction members. Each elongated construction member has a tongue on one load bearing edge and a groove on the other load bearing edge, and a passageway in the construction member for communicating with either the tongue or groove thereon for injecting structural grout into a space between a tongue on one construction member and a groove engaged therewith on another like construction member stacked thereon to form a unitary free standing load bearing wall of a building.

18 Claims, 5 Drawing Sheets

FREE STANDING WALL CONSTRUCTION, A METHOD OF CONSTRUCTING SAME, AND A PRECAST ELONGATED CONSTRUCTION MEMBER

This invention relates to free standing load bearing wall construction for supporting a roof, floors, etc., of light industrial and commercial buildings, a precast elongated beam construction member useful in such construction, and a method of erecting such wall construction. These light industrial and commercial buildings include warehouses, shopping centers, small factories, garages, motels, industrial equipment enclosures, and the like.

One style of free standing load bearing wall construction useful for light industrial and commercial buildings involves laying masonry units such as block or brick requiring substantial amounts of costly labor and material. Examples of such units is illustrated by Hackman U.S. Pat. No. 764,459; Stewart, Jr. U.S. Pat. No. 3,422,588 and Warren U.S. Pat. No. 4,016,693.

Another type of free standing load bearing wall construction is the wooden log building erected from logs milled with tongue and groove engaging means, and stacked on each other, particularly in areas where abundant supplies of high quality logs are available. The wooden log structures are illustrated by Ward U.S. Pat. No. 2,021,341; Johnson U.S. Pat. No. 3,189,950 and Chisum 4,126,977.

Another type of free standing load bearing wall construction is cast in situ walls, which require placing and supporting molds in position during pouring, and maintaining the molds in position during time consuming curing of the cast wall structure, particularly when the wall forms are elevated for pouring upper portions thereof.

Heretofore many of these light industrial and commercial buildings have been erected from metal or precast masonry structures, which require supplementary load bearing horizontal and/or vertical structure and therefore materially increases the cost of construction. Such precast structures are illustrated by Tyson 3,435,567; Godley et al U.S. Pat. No. 3,600,864 and Brown U.S. Pat. No. 4,219,978.

Accordingly, it is an object of this invention to utilize a novel precast elongated beam construction member to erect a free standing load bearing construction wall that is not only more economical and more quickly built but is also as strong or stronger than the existing prior art types.

Another object of the present invention is to provide a novel precast elongated beam construction member which has tongue and groove engaging means on the load bearing surfaces and on end-to-end and corner surfaces.

A further object of this invention is to provide a free standing load bearing wall construction, a method of constructing same, and a novel precast elongated beam construction member with a passageway for conveying structural grout under pressure into the space in the joint between the last two stacked courses of precast elongated construction members and the space in the joint between the tongue and groove on the ends thereof. This in situ structural grouting of the lengthwise and end tongue and groove joints seals and bonds the stacked precast elongated members together into an improved integral wall structure.

Yet another object of this invention is to provide an attractive free standing load bearing wall construction defining the entire wall thickness of the building from precast elongated beam construction members having desired exterior and interior wall finishes, such as a brick or other desired pattern external wall and textured finish interior wall developed during casting said members on site in molds with desired patterns on the interior thereof.

Other objects and advantages of this invention will become apparent from the description of the Figs. of the drawing.

DETAILED DESCRIPTION OF DRAWING

Figure 1:
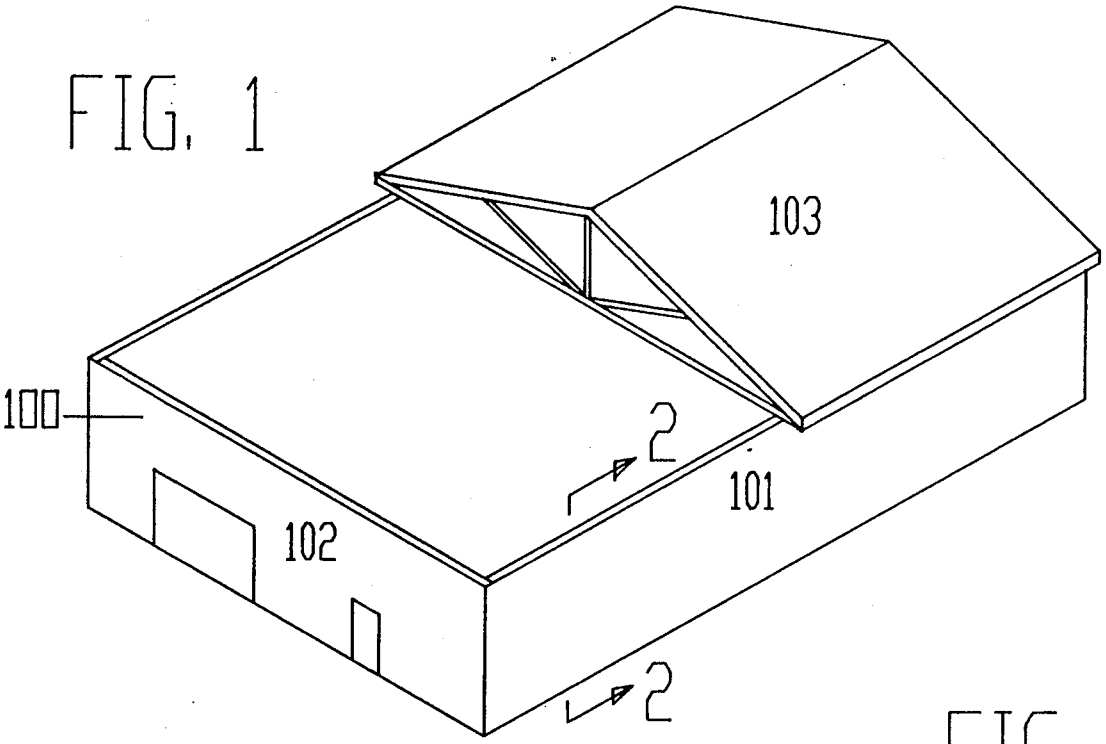
FIG. 1 illustrates a prospective view of a utility building having a roof structure supported on free standing load bearing side and end walls constructed from a plurality of novel precast elongated beam construction members stacked one on the other of this invention.

In the drawing, FIG. 1 shows a prospective view of a utility building 100 for light industrial or commercial use having a roof structure 103 supported on free standing load bearing side walls 101 and end walls 102. The side walls 101 and end walls 102 are erected from a plurality of novel precast elongated construction members 1 shown in cross-section in FIGS. 2 and 5 and in prospective in FIGS. 3 and 4. Also shown in FIG. 2 are precast load bearing elongated starter component **1*b*, seated on a perimeter footing of a building, and precast load bearing elongated capping component 1*a*, both of which have either appropriate lengthwise extending tongues 4 or grooves 5 on load bearing edges thereof for engagement with corresponding grooves 5 or tongues 4 on the load bearing edges 7 or 8 of precast elongated beam member 1**.

Each elongated precast beam construction member 1 is molded from portland cement, fine aggregate, larger aggregate, such as stone, cinders or the like, and water, and is formed in lengths approximately 12 feet to 20 feet, widths or thicknesses of approximately 8 inches to 12 inches, and heights of approximately 16 inches to 32 inches. The width or thickness of the construction member 1 used will be increased for buildings having higher walls. It is noted that half lengths (see FIG. 9—upper left end) of said construction 1 will be used to provide a staggered relationship in the end joints of adjacent courses of said construction members 1 around the perimeter of the building wall to increase the strength of the construction wall. The elongated precast construction member 1 may be molded, as shown in FIG. 5, with reinforcement wires or rods 19 embedded therein to increase the strength thereof, particularly for lifting purposes, and may have insulation blocks 18 spaced along the length thereof and embedded therein to insulate the building and to decrease the weight thereof.

Figure 2:
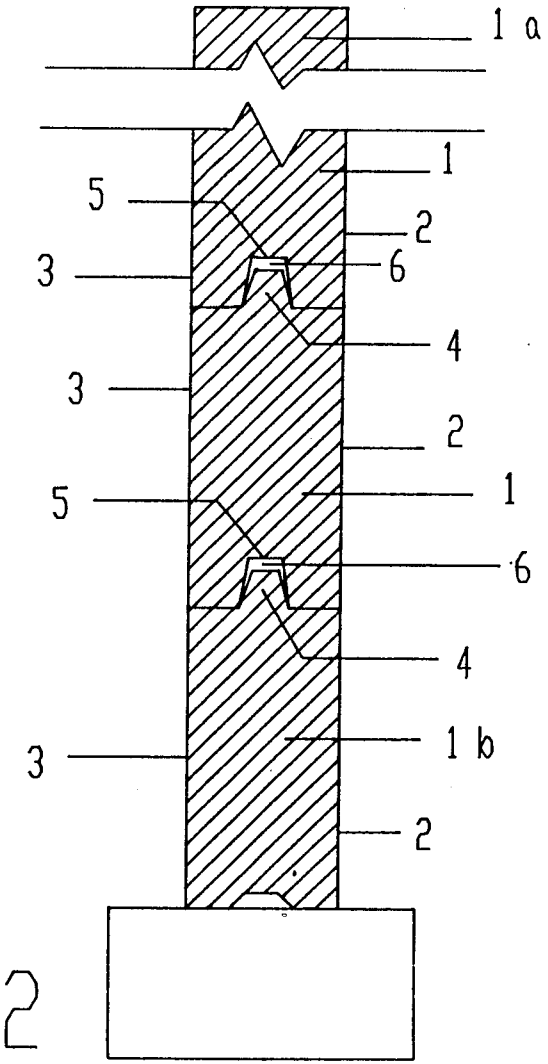
FIG. 2 illustrates a partial cross-sectional view of a wall with novel precast construction members taken on line 2—2 of FIG. 1.
Figures 3, 4, 5:
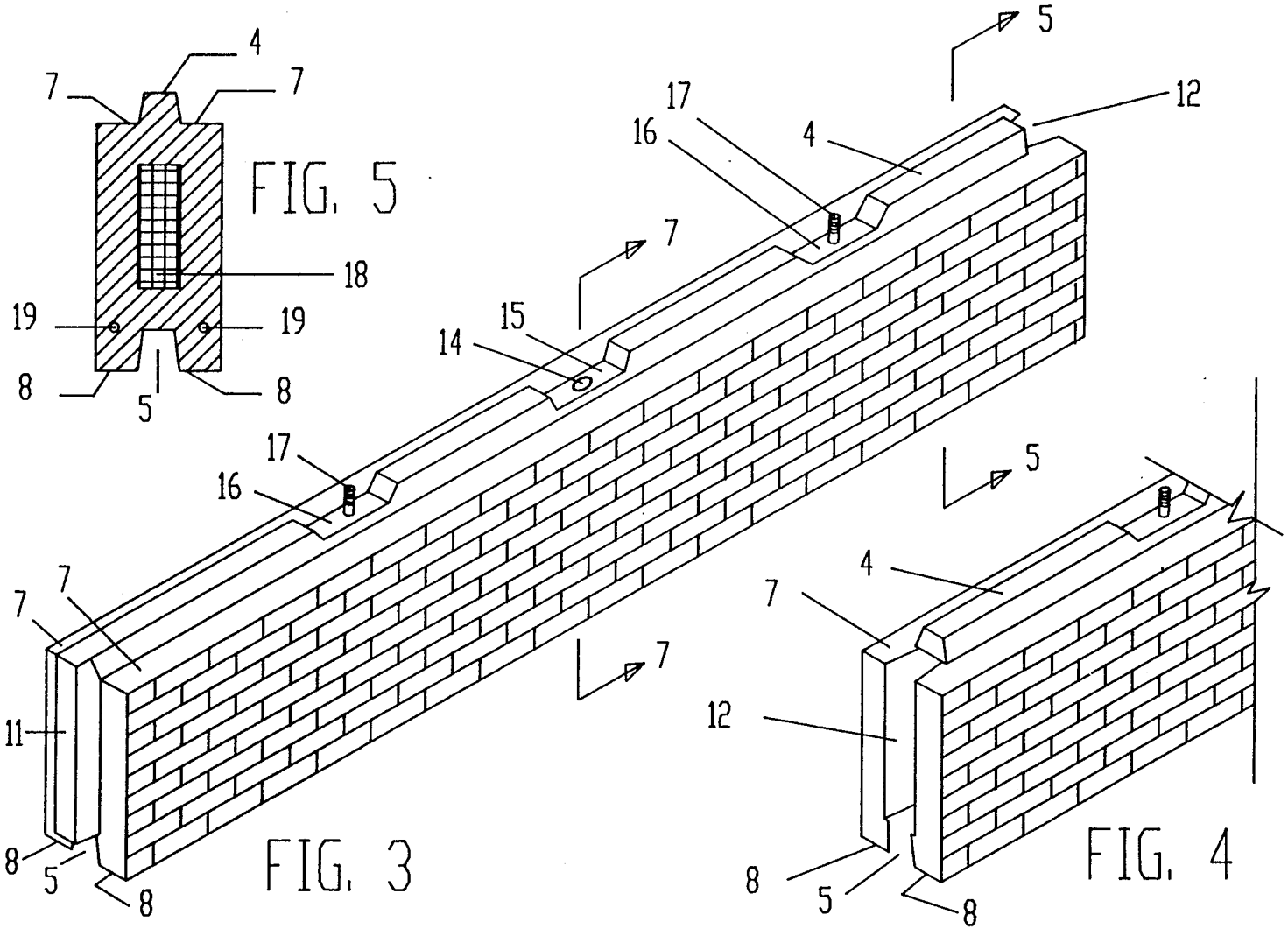
FIG. 3 illustrates a prospective view of a novel precast beam construction member and unique features thereof.
FIG. 4 illustrates a partial prospective view of the right end of the novel precast construction member of FIG. 3.
FIG. 5 is a cross-sectional view on line 5—5 of FIG. 3.
Figure 6:
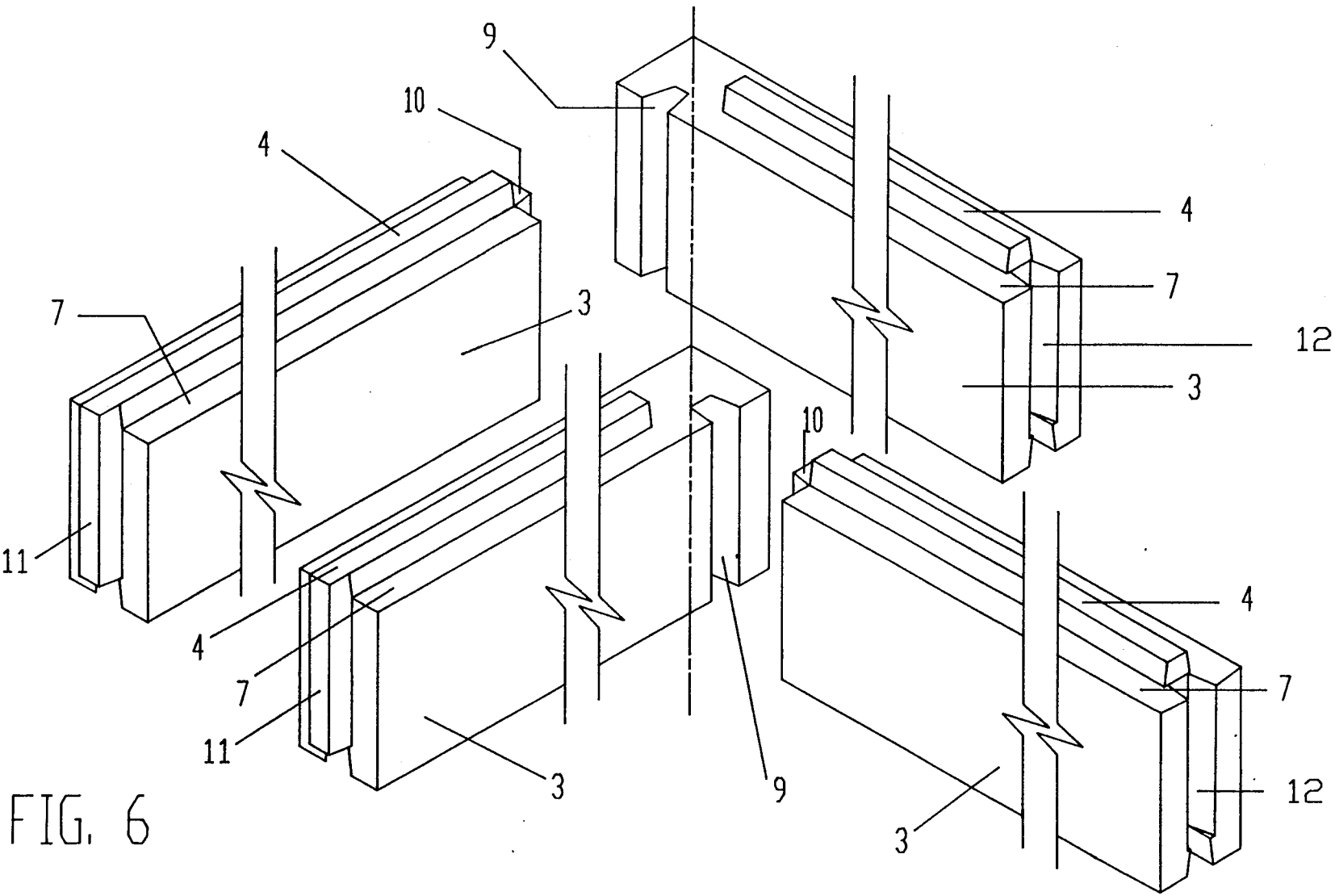
FIG. 6 is an exploded view of corner joints in several courses of novel elongated precast beam construction members along a center line.
Figure 7:
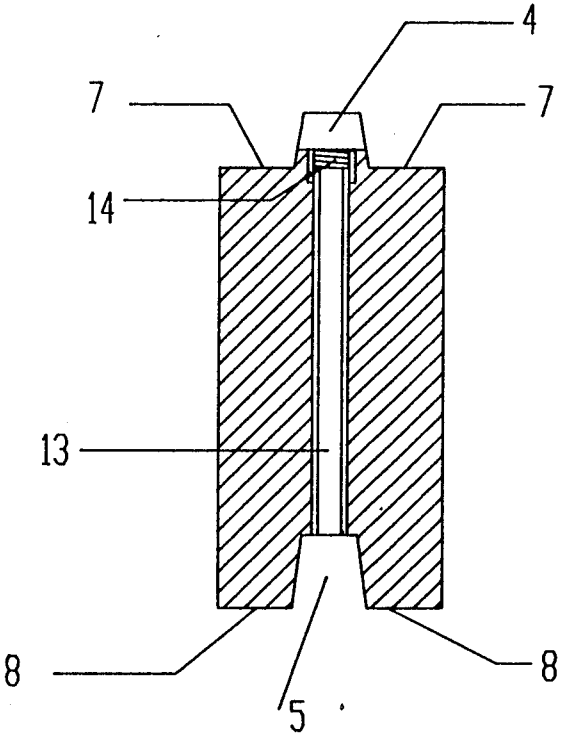
FIG. 7 is a cross-sectional view taken along line 7—7 of FIG. 3.
Figure 8:
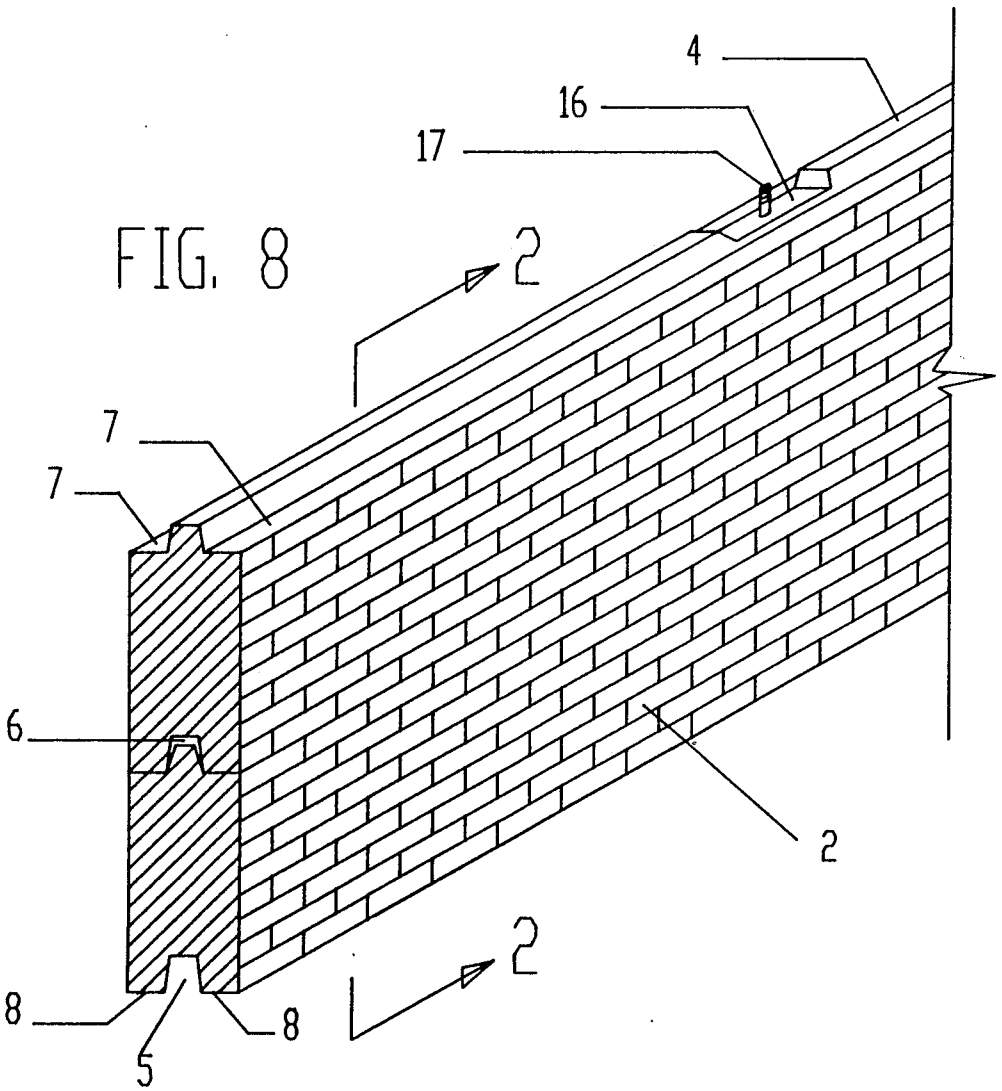
FIG. 8 is a partial prospective view of two precast beam construction members in stacked relationship.
Figure 9:
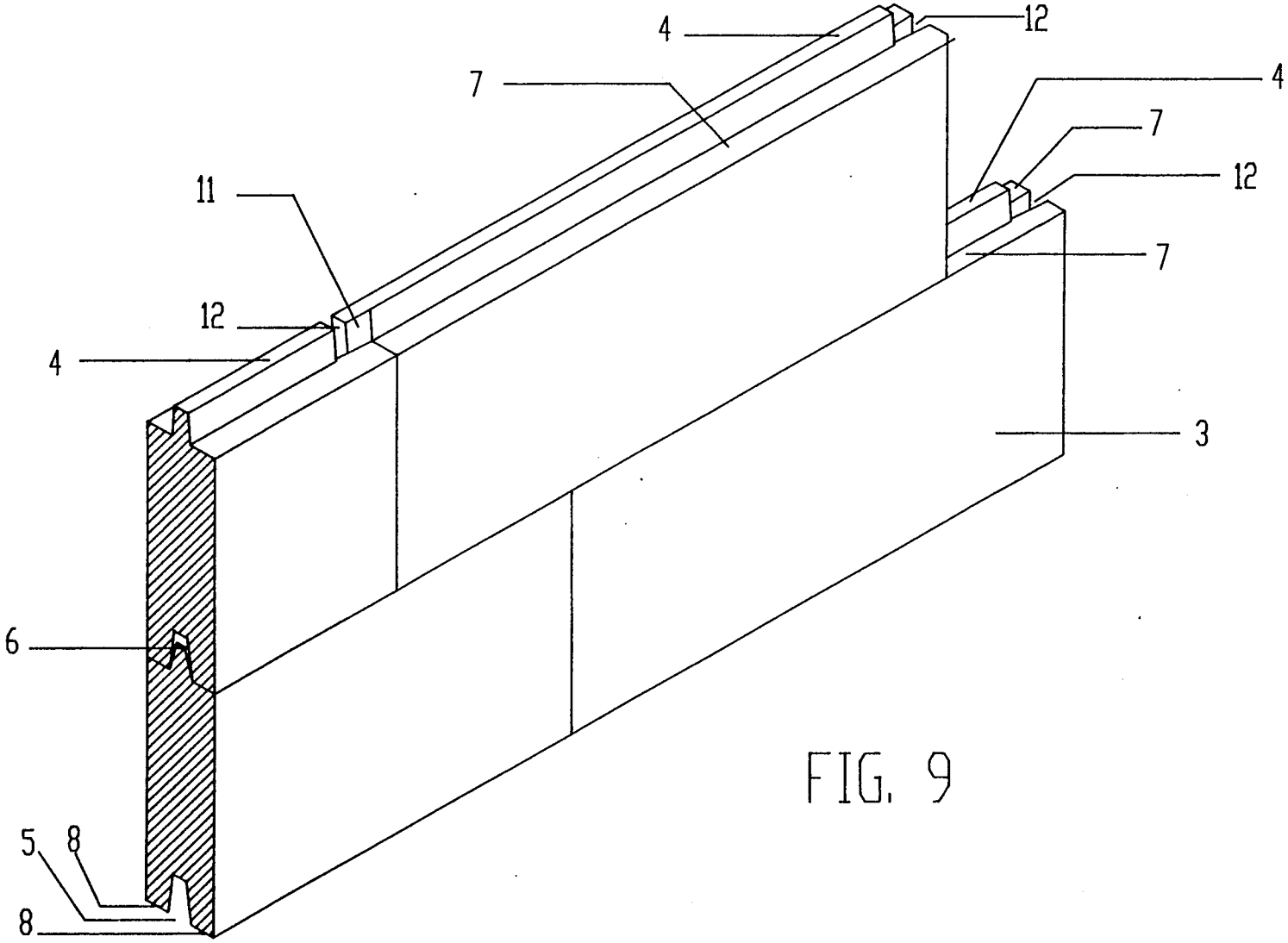
FIG. 9 is a partial prospective view of a plurality of novel precast beam construction members stacked with end joints in staggered relationship.

Elongated precast beam construction member 1, as shown in FIG. 2, has a vertical front face 2 with a simulated brick or other desired pattern thereon as shown in FIGS. 3, 4 and 8, if desired, and a vertical rear face 3 with a desired interior textured finish thereon, an upper horizontal load bearing edge 7 with an outwardly tapering tongue 4 thereon, and a lower horizontal load bearing edge 8 having an inwardly tapering groove 5 therein. Outwardly tapered tongue 4 has converging side surfaces extending outwardly from a base of the tongue 4 on the load bearing edge 7, and the base of the tongue being spaced inwardly of said front and rear faces 2 and 3. The relationship of the angle of taper of the walls of the groove 5 and the angle of taper of the side faces of the tongue 4, as well as the depth of the groove 5 being greater than the height of the tongue 4, combining when a tongue 4 on one member 1 is engaging a groove 5 in another member 1 in stacked relationship to define a space 6 between an engaged tongue 4 and groove 5 for receiving structural grout that seals and bonds the stacked members 1 together to form a unitary wall structure. The size and shape of the groove 5 being such that the outer edge thereof snugly engages the base of tapered tongue 4 on a load bearing edge of another corresponding construction member 1 to effectively prevent structural grout injected into space 6 from flowing between bearing faces 7 and 8. The construction members 1 also have similar tongues 11 and grooves 12 on the ends thereof for engagement with other construction members 1 in end-to-end relationship while leaving a grout receiving space therebetween, as shown in FIGS. 3, 4 and 9. Also corner construction members 1 have similar grooves 9 and tongues 10 on the ends thereof for corner joint engagement with other corner construction members 1 while leaving a grout receiving space therebetween, as shown in FIG. 6. The structural grout, which is a portland cement, fine aggregate or the like and water, is injected into the space between the tongues and grooves in the lengthwise, end-to-end and corner joints by means of a conventional pressure injection device adapted to be connected to a threaded end 14 of injection tube 13 exposed in a notch 15 in the groove 5 or tongue 4 of construction member 1 as shown in FIGS. 3 and 7.

As shown in FIGS. 3 and 8, notches 16 having lifting attachment means 17 mounted therein are spaced along the length of construction member 1 for lifting same from a supply of construction members 1 adjacent the perimeter footing into stacked position in the vertical construction wall by means of a lifting device such as a crane.

The method of erecting a free standing load bearing wall structure and the wall produced thereby includes the steps of providing on a perimeter footing in end-to-end and corner engagement precast elongated starter components **1*b* having grooves or tongues in an upper load bearing portion thereof, providing a supply of elongated precast construction members 1 adjacent the perimeter footing, lifting and placing a first course of the elongated members 1 with tongue 11 and groove 12 end joints on the load bearing portion of said starter component 1*b* and with the tongues or grooves of the lower load bearing edge 8 of the elongated members 1 engaging the grooves or tongues of the load bearing portion of the starter components 1*b* on the perimeter footing to define a lengthwise space between the engaged tongues and grooves, injecting structural grout into the passageway 13 of each elongated member 1 to fill the space between and along the lengths of the engaged tongues and grooves of the starter components 1*b* on the perimeter footing and the elongated members 1 to seal and bond same into a unitary structure, lifting and placing a lower load bearing edge 8 of a second course of elongated member 1 on the upper load bearing edge 7 of the first placed course of elongated members 1 with tongue 11 and groove 12 end joints thereof staggered relative to the tongue 11 and groove 12 end joints of the elongated members 1 in the first placed course, and with said tongues or grooves of the lower load bearing edge 8 of the second course of the elongated members 1 engaging the tongues or grooves in the upper load bearing edge 7 of the first placed course of elongated members 1 to define a lengthwise space between the engaged tongues and grooves, injecting under pressure structural grout into passageway 13 of each elongated member 1 in the second placed course to fill the space between and along the lengths of the engaged tongues and grooves of said first and second courses of elongated members 1 to seal and bond the elongated members 1 in the first and second courses into an integral structure, and repeating the steps of lifting and placing additional courses of the elongated members 1 on the last placed course of elongated members 1, and injecting structural grout under pressure into passageway 13 of each elongated member 1** in each last placed course to fill the space between and along the lengths and end joints of the engaged tongues and grooves to seal and bond the elongated members into an integral structure until the desired height integral free standing load bearing wall structure is attained.

The claims to the invention are as follows.

I claim:

1. An elongated load bearing beam construction member for use in erecting a free standing wall comprising an elongated precast body having front and rear vertical side faces, first and second vertical end edges, and upper and lower horizontal load bearing edges, one of said upper and lower load bearing edges and one of said first and second end edges having a tapered tongue extending lengthwise and outwardly thereof, said tongue having side surfaces extending convergingly outwardly from a base at said one load bearing edge and said one end edge, said tongue base being spaced inwardly of said side faces, the other of said upper and lower load bearing edges and the other of said first and second end edges having a groove extending lengthwise and inwardly thereof, said groove being spaced inwardly of said side faces distances the same as the distances of the base of said tongue from said side faces whereby said groove is of a size and shape for snugly engaging the base of a tapered tongue on one load bearing edge and one end edge of other like corresponding members, said groove being deeper than the height of said tongue on said one of said upper and lower load bearing edges and one of said first and second end edges on said other members whereby said groove is deeper than the height of said tongue on said other members so as to define therewith a structural grout receiving lengthwise space about said side surfaces of said tongue on said other members, and a passageway in said precast body communicating with either said tongue or groove for injecting structural grout under pressure into said space to form a unitary free standing load bearing wall.

2. An elongated load bearing construction member according to claim 1, wherein said elongated member front vertical side face further includes a simulated brick or other desired pattern thereon.

3. An elongated load bearing construction member according to claim 1, wherein said elongated precast body further includes a plurality of embedded insulation blocks spaced along the length thereof for insulative properties and weight reduction.

4. An elongated load bearing construction member according to claim 1, wherein said elongated precast body further includes embedded longitudinally extending reinforcement elements to increase the strength thereof for lifting purposes.

5. An elongated load bearing construction member according to claim 1, wherein said elongated precast body further includes a plurality of longitudinally spaced lifting attachment means partially embedded therein on said upper load bearing edge for use in lifting said member into position on the building wall.

6. A free standing load bearing wall structure of a building including a plurality of elongated load bearing beam construction members, each elongated member comprising an elongated precast body having front and rear vertical side faces, and upper and lower horizontal load bearing edges, one of said upper and lower load bearing edges having a tapered tongue extending lengthwise and outwardly thereof, said tongue having side surfaces extending convergingly outwardly from a base at said one load bearing edge, said tongue base being spaced inwardly of said side faces, the other of said upper and lower load bearing edges having a groove extending lengthwise and inwardly thereof, said groove being spaced inwardly of said side faces, said groove being of a size and shape for snugly engaging the base of a tapered tongue on one load bearing edge of another corresponding elongated member, said groove being deeper than the height of said tongue on said another elongated member so as to define therewith a structural grout receiving lengthwise space about said side surfaces of said tongue on said another elongated member, said body further including a passageway communicating with either said tongue or groove for injecting structural grout under pressure into said space between said groove and said tongue on said another member, a stack of said elongated members having tongue and groove engagement with the groove on one elongated member snugly engaging the base of the tongue on another elongated member to define a lengthwise space between said engaged tongue side surfaces and groove, and said space between said engaged tongue side surfaces and groove being filled with solidified structural grout that sealed and bonded said member together in a unitary structure.

7. A free standing load bearing wall structure according to claim 6, wherein said front vertical side face further includes a simulated brick or other desired pattern thereon.

8. A free standing load bearing wall structure according to claim 6, wherein said elongated precast members further includes a plurality of embedded insulation blocks spaced along the length thereof for insulative properties and weight reduction.

9. A free standing load bearing wall structure according to claim 6, wherein said elongated precast members further include embedded longitudinally extending reinforcement elements to increase the strength thereof for lifting purposes.

10. A free standing load bearing wall structure according to claim 6, wherein said elongated members include a plurality of longitudinally spaced lifting attachment means partially embedded therein on said upper load bearing edge for use in lifting said elongated precast members into position on said building wall.

11. A free standing load bearing wall structure according to claim 6, wherein each elongated member in said stack includes other elongated members joined end-to-end and at corners to complete a course about the perimeter of a building and the space between each tongue and groove is filled with structural grout.

12. A free standing load bearing wall structure according to claim 11, wherein one end of said elongated member is provided with a vertical groove and the other end thereof is provided with a vertical tongue, and the elongated members in each course are joined end-to-end by tongues and grooves with a space defined between the end tongue and groove for receiving structural grout therebetween.

13. A method of erecting a free standing load bearing wall structure including a plurality of corresponding elongated precast beam construction members stacked one on the other, each member comprising an elongated precast body having front and rear vertical side faces, and upper and lower horizontal load bearing edges, one of said upper and lower load bearing edges of each member having a tapered tongue extending lengthwise and outwardly of said one load bearing edge, said tongue having side surfaces extending convergingly outwardly from a base at said one load bearing edge, said tongue base being spaced inwardly of said side faces, the other of said upper and lower load bearing edges having a groove extending lengthwise and inwardly thereof, said groove being spaced inwardly of said side faces and being of a size and shape for snugly engaging the base of a tapered tongue on one load bearing edge of another corresponding member, said groove being deeper than the height of said tongue on said another member so as to define therewith a structural grout receiving space about said side surfaces of said tongue on said another member, and a passageway in said precast body communicating with either said tongue or groove for injecting structural grout under pressure into said space between said groove and said tongue on said another member to form a unitary free standing load bearing wall, comprising the steps of providing on a perimeter footing an elongated precast starter component having an upper load bearing portion with either a groove or a tongue for receiving said tongue or groove on said lower load bearing edge of said elongated member, providing a supply of said elongated members adjacent said perimeter footing, lifting and placing a first elongated member on said load bearing portion of said starter component on said footing with said tongue or groove of said lower load bearing edge of said elongated member engaging said groove or tongue of said load bearing portion of said starter component on said perimeter footing to define a lengthwise space between said engaged tongue and groove, injecting under pressure structural grout into said passageway of said first elongated member to fill said space between and along the length of the engaged tongue and groove of said load bearing starter component on said footing and said first elongated member, lifting and placing said lower load bearing edge of a second elongated member on said upper load bearing edge of said first placed elongated member with said tongue or groove of said lower load bearing edge of said second elongated member engaging said groove or tongue of said upper load bearing edge of said first placed elongated member so that said groove snugly receives the base of said tongue such that the side surfaces of said tongue and said groove define a lengthwise space between said engaged tongue and groove, injecting under pressure structural grout into said passageway of said second elongated member to fill the space between and along the length of the engaged tongue and groove of said first and second placed elongated members, and repeating the steps of lifting and placing elongated members one on the other, and injecting structural grout through the passageway of each last placed elongated member into said space between and along the lengths of the engaged tongue side walls and groove until the desired height free standing load bearing wall is attained.

14. A method of erecting a free standing load bearing wall structure according to claim 13, further including forming said elongated member front vertical side face with a simulated brick or other desired pattern thereon.

15. A method of erecting a free standing load bearing wall structure according to claim 13, further including forming said elongated precast members with a plurality of embedded insulation blocks spaced along the length thereof for insulative properties and weight reduction.

16. A method of erecting a free standing load bearing wall structure according to claim 13, further including forming said elongated precast members with embedded longitudinally extending reinforcement elements to increase the strength thereof for lifting purposes.

17. A method of erecting a free standing load bearing wall structure according to claim 13, further including forming said elongated precast member with a plurality of longitudinally spaced lifting attachment means partially embedded therein on said upper load bearing edge for use in lifting said member into position on the building wall.

18. A method of erecting a free standing load bearing wall structure according to claim 13, wherein the step of providing a starter component on the footing further includes providing additional starter components on the footing in end-to-end and corner engagement, the step of lifting and placing said elongated member on the starter member further includes lifting and placing said elongated members on the starter members in end-to-end and corner engagement, and the step of injecting structural grout through the passageway of the elongated member further includes injecting structural grout through the passageway of each elongated member into the space between the tongue and groove of each elongated member and the starter member and the last placed elongated member and the previously placed elongated member to form a unitary wall.

* * * * *